United States Patent [19]

Sullivan

[11] 4,237,583

[45] Dec. 9, 1980

[54] LOCKING CLIPS FOR SECURITY WALLETS AND THE LIKE

[76] Inventor: William H. Sullivan, 5527 Shasta La., La Mesa, Calif. 92041

[21] Appl. No.: 8,247

[22] Filed: Feb. 1, 1979

[51] Int. Cl.[3] ..... A45C 13/18; A45F 5/02

[52] U.S. Cl. ..... 24/3 R; 24/3 H; 24/3 J; 24/248 E; 150/47; 224/252; 224/269

[58] Field of Search ..... 24/3 R, 3 C, 3 F, 3 H, 24/3 J, 3 L, 3 G, 248 B, 248 E; 150/47; 224/252, 269

[56] References Cited

U.S. PATENT DOCUMENTS

| | | | |
|---|---|---|---|
| 806,750 | 12/1905 | Padmore | 24/3 H |
| 1,075,587 | 10/1913 | McKeen | 24/3 R |
| 1,455,596 | 5/1923 | Morrison | 24/248 E |
| 1,516,035 | 11/1924 | Adamich | 24/3 H |
| 1,692,712 | 11/1928 | Tannebaum | 24/3 J |
| 2,551,515 | 5/1951 | Tschirf | 24/3 L |
| 2,697,861 | 12/1954 | Shively | 24/3 H |
| 3,297,070 | 1/1967 | Jeffers | 150/47 |
| 3,808,642 | 5/1974 | Nation | 24/3F |
| 3,982,675 | 9/1976 | Claypool | 224/252 |
| 4,060,876 | 12/1977 | De Soto | 24/3 J |

*Primary Examiner*—Victor N. Sakran

*Attorney, Agent, or Firm*—Bruno J. Verbeck; Michael L. Slonecker

[57] ABSTRACT

A security wallet be attached to the waistband of a person's garment for disposition between the person's body and the garment is securely but detachably mounted to the waistband by a locking device comprising an inverted U-shaped clip, at least one latch member on said clip interiorly thereof having a serrated edge thereon, and means comprising a rotary shaft for moving each said latch member from a first open position adjacent one wall of said clip to a second closed position wherein said serrated edge thereof is adjacent the other wall of said clip. The latch member or members in open position permit easy attachment of the clip to and easy detachment of the clip from a waistband, and in closed position confine waistband material between each latch member and said other wall of said clip so that attempted removal of said clip from the waistband results in the serrations on each latch member digging into the waistband material and preventing removal of said clip and wallet from the waistband. The rotary shaft for moving the latch member or members preferably has limited access means for rotating the same from closed to open position so that the clip can be opened and the wallet removed from the waistband only by authorized persons. While particularly devised for mounting security wallets, the locking clip has other comparable uses as well.

8 Claims, 6 Drawing Figures

LOCKING CLIPS FOR SECURITY WALLETS AND THE LIKE

BACKGROUND OF THE INVENTION

Concern for the prevention of theft or accidental loss of valuables carried on one's person has resulted in numerous inventions intended to alleviate the problem. Such designs have varied from conventional money belts to belt supported security receptacles, such as shown in U.S. Pat. Nos. 1,007,505; 1,416,238; and 1,493,594, for example; to wallets with clip assemblies attachable to a belt, such as shown in U.S. Pat. Nos. 2,908,306 and 4,060,876; to wallets equipped with purported locking clips for securely locking the same to articles of clothing, such for example as shown in U.S. Pat. Nos. 2,126,826; 2,652,873; and 2,697,861.

While the prior art devices referred to provide a limited degree of protection for valuables, they possess certain drawbacks which render them not entirely satisfactory.

Security receptacles which are incorporated into the construction of garments tend to reduce the aesthetic appeal of such garments. Devices which are removably clipped to clothing or belts possess the significant disadvantage that they may readily be removed from the clothing without the knowledge of the wearer. The few locking clips heretofore proposed suffer the disadvantage that they have merely a friction fit with the clothing, and thus can also be removed without the wearer's knowledge.

SUMMARY OF THE INVENTION

The present invention relates to a security wallet or receptacle within which a person may carry articles of value without fear of theft or accidental loss.

More particularly, the invention relates to a locking device or clip to which a wallet or like receptacle can be secured and which in turn can be securely but detachably locked to an article of apparel or the like, for example, the waistband of a skirt or a pair of trousers, slacks, or shorts, so that the wallet cannot be removed from the apparel except by authorized persons.

The locking device of the invention comprises a U-shaped clip member, which when inverted can be slipped over a waistband and to which a wallet or the like can be securely affixed; one or more latch members within the interior of the clip, at least one of which has upwardly facing serrations or tines thereon; and means for moving the latch member or members from a first open position wherein the latch members are adjacent one wall of the clip so that a waistband or the like can be inserted between the latch members and the other wall of the clip, and a second closed position wherein the serrated or tined portions of the latch member or members are adjacent said other wall of the clip, and thus confine the waistband material between the latch members and said other wall. In this condition, the clip securely holds the wallet to the waistband, but the serrations or tines do not pierce or otherwise damage the garment. However, should a pickpocket or other unauthorized person attempt to remove the wallet, the upward force on the clip causes the serrations or tines on the latch members to dig into the fabric or material of the waistband, and thereby prohibit and prevent further efforts to remove the wallet.

For greatest security, a plurality of said latch members are provided, some with the serrations or tines thereon facing upwardly and at least one with the serrations or tines thereon facing downwardly.

The means for moving said latch members is preferrably in the form of a rotary shaft, as this results in a particularily compact assembly and also permits provision of limited access means for rotating the shaft at least from latch closed position to latch open position, so that the locking latches cannot be opened except by authorized persons.

Additional features of the invention will become apparent from the following detailed description, as taken in conjunction with the accompanying drawings.

DESCRIPTION OF THE PREFERRED EMBODIMENT

Figure 1:
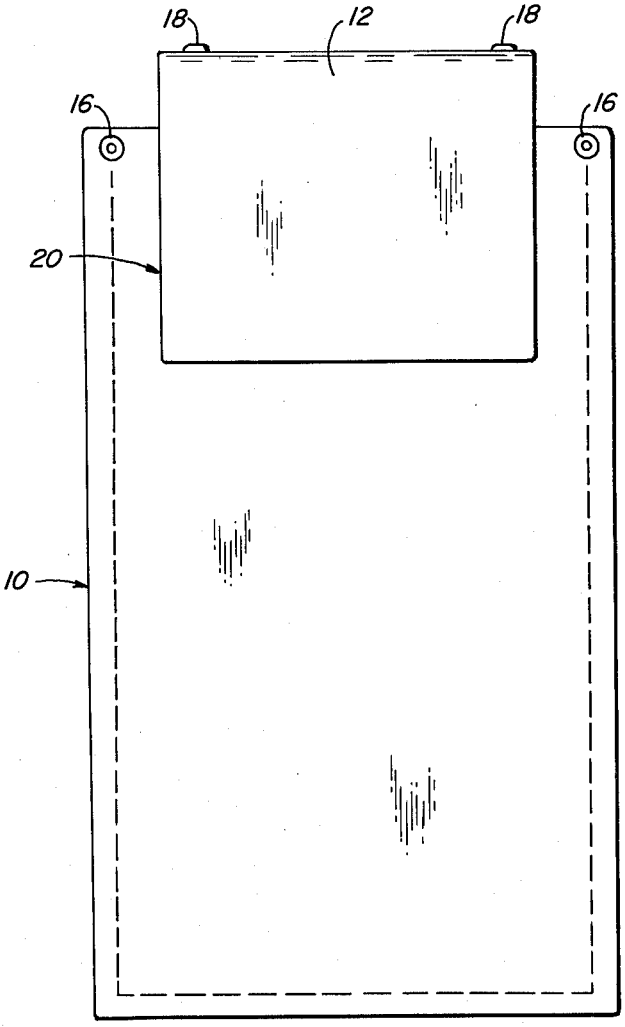
FIG. 1 is a front elevation of a security wallet equipped with a perforated embodiment of the locking device or clip of the present invention.
Figure 2:
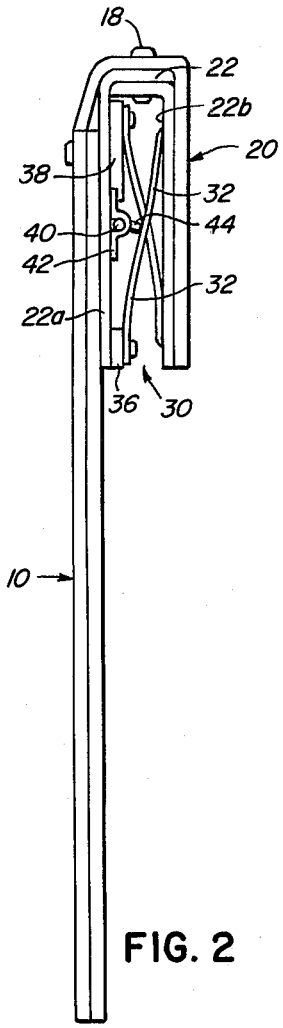
FIG. 2 is a side elevation of the security wallet shown in FIG. 1.

Referring to FIGS. 1 and 2, a security wallet is shown consisting of a wallet, pouch, or similar receptacle 10 having an integral closing flap 12, and a locking device or clip 20 to which the flap is securely affixed. The pouch or wallet 10 may be formed from two sheets of leather or other appropriate material stitched together at their side and bottom edges to form an open top pouch. If desired, the pouch may be reinforced by rivets 16 or the like. Manifestly, any appropriate wallet construction may be employed as desired. The flap 12 is formed integral with the sheet which is intended to face the body of the wearer and is preferably of a size and shape to cover the outer surface of the device 20. The flap is securely attached by fasteners 18 and/or any suitable adhesive to the top and outer surfaces of the locking device.

Figure 3:
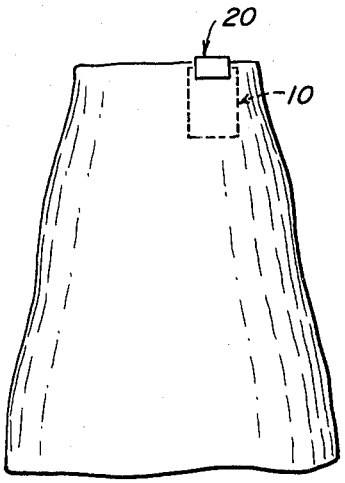
FIG. 3 is a front elevation showing the manner in which the security wallet would be affixed to the waistband of an item of wearing apparel.

The locking device 20 comprises a U- or channel-shaped clip or body member 22 which is adapted to be inverted and slipped over the waistband of an article of wearing apparel, such as a skirt or a pair of shorts, trousers, or slacks. Thus, as shown in FIG. 3, the wallet 10 can be disposed between the wearer's body and the article of wearing apparel with the wallet supported from the waistband thereof by the clip 20. Mounted within the interior of the U- or channel-shaped body 22 is a locking mechanism 30 (a preferred embodiment of which will be described hereinafter) for securely locking the clip and thus the wallet 10 to the waistband of the wearer's skirt, shorts, or slacks. To facilitate the installation of the locking mechanism, the clip or body member is preferably comprised of two L-shaped members 22*a* and 22*b* which are adapted to be secured together at their shorter legs, as by welding or rivets or the like. The locking mechanism may therefore be mounted on the inner surface of the longer or main leg or wall of one of the L-shaped members, preferably the member 22*a* adjacent the wallet 10 and thus adjacent the wearer's body, after which the L-shaped member 22*b* can be secured to the member 22*a* to enclose the mechanism within the U or channel defined by the two members. Alternatively, a single sheet of suitable channel material could be bent to U form after installation of the locking machanism thereon.

The locking mechanism is preferably mounted on the wall of the U adjacent the wearer's body so that the exposed portion of the assembly, as shown in solid lines in FIG. 3, is as inconspicuous and aesthetically attractive as possible, and so that the operating means for the locking mechanism is confined within the portion of the U between the apparel and the wearer's body, and thus concealed from view for purposes of maximum security.

Figure 4:
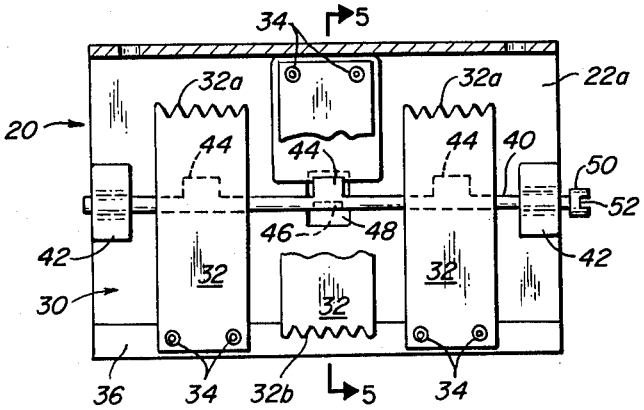
FIG. 4 is a longitudinal, vertical section of the preferred embodiment of the locking device of the invention, the view being taken substantially on line 4—4 of FIG. 5.
Figure 5:
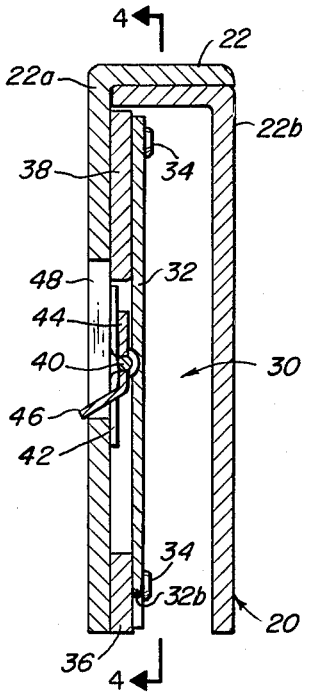
FIG. 5 is a vertical cross-section of the preferred embodiment of the locking device, the view being taken substantially on line 5—5 of FIG. 4 and showing the locking device or clip in its open position.
Figure 6:
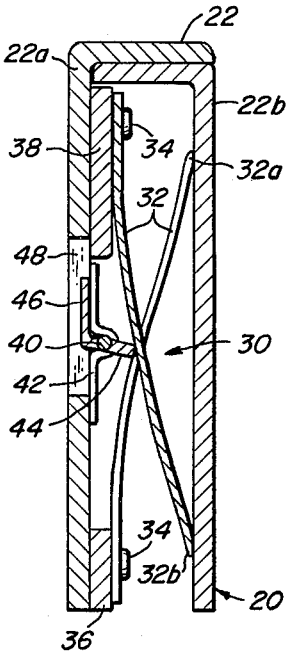
FIG. 6 is a view similar to FIG. 5, but showing the locking device or clip in its closed or locked position.

Referring particularly to FIGS. 4, 5, and 6, the locking mechanism 30 is mounted on the interior surface of the wall 22*a* of the clip member 22. The mechanism comprises a plurality of latch members 32, at least one of which has an upwardly facing serrated or tined edge 32*a*, and at least one of which has a downwardly facing serrated or tined edge 32*b*. In the preferred embodiment, there are three latch members 32, each comprised of a vertically extending resilient leaf spring mounted on the wall 22*a* at one end thereof, and each having serrations or tines at the opposite, free end thereof, said serrations, in the unlock position, resting below the raised surface of bars 38 or 36. The central one of the leaf springs is mounted at its upper end near the top of the wall 22*a*, thereby to define downwardly facing tines or serrations 32*b* at its lower end, and the two outboard springs are mounted at their lower ends adjacent the lower edge of the wall 22*a* thereby to define upwardly facing tines or serrations 32*a* at their upper ends.

The outboard latch members or leaf springs 32 are mounted by means of rivets 34 or the like on a spacer bar 36 which extends along the lower edge of the interior surface of the wall 22*a* and which is secured thereto as by welding or the like, or by the same rivets 34 which mount the leaf springs on the bar. Similarly, the center latch member or leaf spring is mounted by means of rivets 34 or the like on a spacer bar 38 secured to the upper central portion of the wall 22*a*. The bar 38 is of vertically extended size for a purpose to be described.

The latch members or leaf springs 32 have a normal or relaxed position in which they are essentially flat, extend substantially parallel to the wall 22*a*, and form a substantially flat, level plane, as shown in FIG. 5. This is the position to which the leaf springs are normally resiliently biased by their inherent spring qualities, and in which they define the open position of the locking mechanism. As will be observed from FIG. 5, with the leaf springs in the illustrated position, the clip 20 may be readily attached to and detached from the waistband of an article of apparel.

Extending longitudinally of the wall member 22*a*, within the space between the wall and the latch members defined by the spacer bars 36 and 38, is a rotary operating shaft 40 which is rotatably mounted on the wall by a pair of bearing blocks or clips 42. At locations thereon aligned with each of the latch members or leaf springs 32, the shaft is provided with a radially outwardly extending cam or lever arm 44, or a comparable protrusion, which upon rotation of the shaft in one direction is adapted to engage the respective spring at a location spaced from its mounted end, and thereupon bend or flex the respective spring to cause the free serrated edge thereof to be moved toward and preferably into forceable engagement with the other wall 22*b* of the clip member 22, as illustrated in FIG. 6. In this position, the serrated edges of the latch members firmly and securely engage the fabric or material of the waistband material within the U, and confine the waistband between the latch members and the wall 22*b*, thereby to define a closed or locked position for the locking clip 20. The rotation required of the shaft 40 to effect complete movement of the free ends of the latch members or leaf springs 32 is in excess of 90° whereby the cams or lever arms 44 move over-toggle relative to the springs and the springs thereupon bias and maintain the shaft in said locked position. To prevent movement of the shaft in a clockwise direction (as viewed in FIGS. 5 and 6) beyond the locked or latched position shown in FIG. 6, the shaft 40 is provided with a locking detent 46 which engages the wall 22*a* or a permanent fixture thereon in the latter position of the shaft.

In accordance with the present invention, the detent 46 is utilized to perform dual functions. Specifically, an opening 48 is formed generally centrally of the wall 22*a* and the detent 46 is extended rearwardly through the opening so as to be accessible to the user when the latching mechanism is in open position. The detent thus forms a convenient operating lever for rotating the shaft from the latch open position shown in FIG. 5 to the latch closed or locked position shown in FIG. 6. In the latter position, in the preferred embodiment of the mechanism, the detent or lever 46 moves into and is entirely concealed within the opening or recess 48 and abuts a portion of the spacer bar 38 which overlies the upper part of the opening 48 for the purpose of defining a locked position stop for the lever 46 and the operating shaft 40. As shown in FIG. 6, the detent or lever 46 in its locked position is not accessible for use in moving the shaft to latch open position, and thus ensures the security of the latching mechanism in its closed position.

In the closed or latched position shown in FIG. 6, the serrated or tined edges of the leaf springs will press firmly against the fabric or other material of the confined waistband, and hold the wallet 10 securely and comfortably in place between the body of the wearer and the article of apparel to which the device is attached. Should a pickpocket or other unauthorized person attempt to remove the wallet 10 or the clip 20, upward force on the clip will cause the tines or teeth 32*a* of the outboard latch members to dig into the waistband fabric or material and thereby prevent further movement of the clip, and prohibit unauthorized removal of the wallet. In similar manner, downward force is normally resisted by the U-bend of the clip member, and in the preferred embodiment, also by the downwardly facing tines or teeth 32*b* on the center latch member. Thus, removal of the wallet by any force having either an upward component or a downward component is prevented. Any other force would not be effective to remove the wallet or the clip. Consequently, the user's valuables are throughly protected against theft or inadvertent loss.

In the preferred embodiment, the tines or teeth on the serrated edges of the latch members are so disposed that absent attempted removal of the wallet, the tines or teeth would not dig into, pierce, penetrate, or otherwise damage the fabric or material of the waistband. To minimize the tendency to snag the textile material, the end teeth or tines on each latch member may be rounded off. On the other hand, if desired, the tines or teeth could be shaped or the springs could be bent or configured so as to achieve at least an initial penetration of some or all of the teeth or tines into the fabric thereby to provide a mechanical or physical as well as frictional interlock and render the clip even more effective in its latched or locked position.

To open the clip mechanism, means could, if desired, be provided for facile opening of the latch mechanism, such, for example, as a second lever comparable to the detent 46, or a different disposition of the detent 46. However, it is a feature of this invention to equip the device with only limited means of access for opening or unlatching movement of the rotary shaft 40, so that the device can be unlocked only by an authorized person. In the illustrated embodiment, this is accomplished by equipping the shaft with an enlarged head 50 protruding slightly beyond one end of the clip member 22, and providing the head with a slot or kerf 52 for reception of a particular coin, e.g., a dime, so that the shaft can be rotated from latch locked position to latch open position by inserting a dime in the slot and turning the shaft. In this regard, the head 50 is sufficiently small in relationship to the sring force exerted on the shaft to mitigate turning of the shaft simply by grasping and trying to turn the head alone. Alternatively, the head could be provided with a special geometric shape of exotic configuration, which could be internal and/or external of the head, to accomodate opening movement of the shaft only by means of a special key complementary to the configuration of the head. In the latter event, it would be preferable to shorten the shaft 40, shift the adjacent bearing block 42 inwardly, and conceal the key receiving head within the confines of the U-shaped clip member 22. In this manner, maximum security against unauthorized opening and removal would be assured.

Thus, the invention has been shown to provide a highly secure and reliable security wallet preventing theft and/or accidental loss of valuables carried on one's person.

While the preferred embodiment of the invention, applied to a particular preferred use, has been illustrated and described herein, it is to be appreciated that various changes, rearrangements, and modifications may be made without departing from the scope of the invention as defined by the appended claims.

What is claimed is:

1. A locking clip for a security wallet to be attached to the waistband of a person's garment for disposition between the person's body and the garment, comprising an inverted U-shaped clip secured to the wallet for suspending the same from a garment waistband, at least one latch member on said clip interiorly thereof having an upwardly facing serrated edge thereon, and means for moving said latch member from a first open position adjacent one wall of said clip to a second closed position wherein said serrated edge thereof is adjacent the other wall of said clip, said latch member moving means being mounted interiorly of said clip upon said one wall between said one wall and said latch member, said member in its open position facilitating attachment of the clip to and detachment of the clip from a waistband, said latch member in its closed position confining waistband material between the latch member and said other wall of said clip so that attempted removal of said clip from the waistband results in the serration on said latch member digging into the waistband material and preventing the removal of said clip and wallet from the waistband.

2. A locking clip as set forth in claim 1, including a plurality of said latch members at least one of which has an upwardly facing serrated edge and at least one of which has a downwardly facing serrated edge.

3. A locking clip as set forth in claim 1 or 2, wherein the means for moving the latch member or members comprises rotary shaft means mounted on said clip having limited access means for rotating the same from closed to open position.

4. A locking clip as set forth in claim 1 or 2, wherein the latch member or members each comprise a leaf spring mounted at one end on the interior surface of the wall of the clip adjacent the wearer's body, having serrations at the free end thereof and being normally resiliently biased towards said one wall, and wherein the means for moving the latch member or members comprises a shaft rotatably mounted on said one wall of the clip and having a protrusion thereon for each latch member for engaging the respective leaf spring at a location spaced from the mounted end thereof and moving the free end thereof toward the other wall of the clip upon rotation of the shaft in one direction and for permitting return of said free end upon rotation of the shaft in the other direction.

5. A locking device as set forth in claim 4, said shaft also including a lever which extends to the exterior of the wall of the clip adjacent the wearer's body in the open position of the latch member or members and is adapted to being manipulated for moving the latch member or members from open to closed position, and limited access means on said shaft for rotating the same in the direction to move the latch member or members from closed to open position.

6. A locking clip for a security wallet or the like, comprising a U-shaped clip to be secured to the wallet or the like, at least one latch member on said clip interiorly thereof, and means for moving said latch member from a first open position adjacent one wall of said clip to a second closed position adjacent the other wall of said clip, said means for moving said latch member comprising rotary shaft means mounted interiorly on a wall of said clip between said wall and said latch member and having limited access means for rotating the same from closed to open position.

7. A locking clip for a security wallet or the like, comprising a U-shaped clip member, at least one latch member on one wall of said clip member interiorly thereof, each latch member comprising a leaf spring mounted at one end on said one wall and normally resiliently biased into a first open position adjacent said wall, a shaft rotatably mounted on said one wall between the wall and each said leaf spring, a protrusion on said shaft for each latch member for engaging the respective leaf spring at a location spaced from the mounted end thereof and for moving the free end thereof to a second closed position adjacent the other wall of the clip member upon rotation of the shaft in one direction and for permitting return of said free end to its open position upon rotation of the shaft in the other direction.

8. A locking clip as set forth in claim 7, including means on said shaft accessible in the open position of each latch member for moving the shaft and each latch member from open to closed position, and limited access means on said shaft for moving said shaft and each latch member from closed to open position.

* * * * *